US005996492A

United States Patent [19]

Jurkewitz et al.

[11] Patent Number: 5,996,492

[45] Date of Patent: Dec. 7, 1999

[54] METHOD AND APPARATUS FOR REGULATING WEB TENSION IN A WEB-FED ROTARY OFFSET PRINTING PRESS

[75] Inventors: Manfred Jurkewitz, Wiesloch; Ulrich Kot, Heidelberg, both of Germany

[73] Assignee: Heidelberg Druckmaschinen Aktiengesellschaft, Heildelberg, Germany

[21] Appl. No.: 09/048,562

[22] Filed: Mar. 26, 1998

[30] Foreign Application Priority Data

Mar. 26, 1997 [DE] Germany ..... 197 12 689

[51] Int. Cl.[6] ..... B41F 5/06

[52] U.S. Cl. ..... 101/228; 101/484; 226/44

[58] Field of Search ..... 101/228, 232, 101/DIG. 42, 219, 220, 221, 222, 223, 224, 225, 226, 227, 484, 485, 486; 226/195, 44, 45, 40; 242/334, 334.1, 334.6

[56] References Cited

U.S. PATENT DOCUMENTS

| | | | |
|---|---|---|---|
| 4,838,498 | 6/1989 | Huth | 242/420.3 |
| 4,896,808 | 1/1990 | Bolza-Schünemann et al. | 226/42 |
| 5,062,296 | 10/1991 | Shiba | 101/228 |
| 5,115,737 | 5/1992 | Amendola | 101/228 |
| 5,269,222 | 12/1993 | Johnson et al. | 101/228 |
| 5,791,541 | 8/1998 | Jitsuishi et al. | 226/44 |

FOREIGN PATENT DOCUMENTS

| | | |
|---|---|---|
| 221 439 A1 | 4/1985 | Germany . |
| 35 90 511 C2 | 4/1986 | Germany . |
| 37 31 214 A1 | 3/1989 | Germany . |
| 43 02 189 A1 | 7/1994 | Germany . |

*Primary Examiner*—Christopher A. Bennett

*Attorney, Agent, or Firm*—Herbert L. Lerner; Laurence A. Greenberg

[57] ABSTRACT

A method for regulating web tension in a web-fed rotary offset printing press includes increasing web tension over a predetermined speed range, substantially linearly with web speed, as the printing press runs up to operating speed, and an apparatus for performing the foregoing method.

13 Claims, 3 Drawing Sheets

METHOD AND APPARATUS FOR REGULATING WEB TENSION IN A WEB-FED ROTARY OFFSET PRINTING PRESS

BACKGROUND OF THE INVENTION

Field of the Invention

The invention relates to a method and apparatus for regulating web tension in a web-fed rotary offset printing press.

Apparatuses and methods for regulating web tension in web-fed rotary offset printing presses have become known heretofore from the prior art and are used to compensate for changes in web tension of the type, which occur during a printing operation.

The German published, nonprosecuted Patent Application (DE-OS) 37 31 214 describes a device for the controlled feeding of web material to printing presses, as well as an appertaining method, with which the deflection of a compensating roller engaging with the running web is measured, and the signal is used to regulate the rotational speed of a pair of tension rollers cooperating with the web. A pneumatic cylinder which actuates the compensating roller is acted upon with constant pressure from a compressed air container connected to a compressed air source, a digital valve being provided between the compressed air source and the compressed air container so as to be able to adjust the pressure and thus the tensile stress of the web to various values. This publication provides no suggestion whatsoever to a person skilled in the art of how to regulate the tensile stress of the web in accordance with or as a function of the web speed.

As has been shown, the first time a web-fed rotary offset printing press is run up to operating speed with a newly inserted web of paper, the problem often occurs that the web will tear or break due to changes in the tensile stress of the web, the causes for which are often ascertainable only with difficulty, the web tears or breaks not only causing a decrease in production but often also damaging parts of the printing presses.

SUMMARY OF THE INVENTION

It is accordingly an object of the invention to provide a method and apparatus for regulating web tension in a web-fed rotary offset printing press which lessens the risk of web tearing or breaking while the web-fed rotary offset printing press is being run up to operating speed.

With the foregoing and other objects in view, there is provided, in accordance with a first aspect of the invention, a method for regulating web tension in a web-fed rotary offset printing press, which comprises increasing web tension over a predetermined speed range, substantially linearly with web speed, as the printing press runs up to operating speed.

In accordance with another mode, the method of the invention includes adjusting the speed range.

In accordance with a further mode, the method includes adjusting the beginning of the speed range to a first web speed value greater than 0.

In accordance with an added mode of the method of the invention, the first web speed value is in a range between 1000 and 2000 copies per hour.

In accordance with an additional mode, the speed range ends at a second web speed value below maximum web speed, and the method of the invention includes keeping the web tension substantially constant above the second web speed value.

In accordance with yet another mode, the method of the invention includes varying the increase in web tension in accordance with the web speed.

In accordance with yet a further mode, the method of the invention includes adjusting the web tension value associated with the first web speed value.

In accordance with yet an added mode, the method of the invention includes adjusting the web tension value associated with the second web speed value.

In accordance with a second aspect of the invention, there is provided a method for regulating the web tension in a web-fed rotary offset printing press, which comprises increasing web tension over a predetermined speed range, nonlinearly with web speed, as the printing press runs up to operating speed.

In accordance with another mode, the method of the invention includes increasing the web tension substantially exponentially with the web speed.

In accordance with a further mode, the method of the invention includes keeping the web tension substantially constant as the printing press runs down.

In accordance with a further aspect of the invention, there is provided an apparatus for regulating web tension in a web-fed rotary printing press, comprising a regulating device including a compensating roller and a pneumatic cylinder for positioning the compensating roller against a moving web of material.

In accordance with another feature of the apparatus of the invention, the pneumatic cylinder is connected to a compressed-air source via a proportional valve.

In accordance with a concomitant feature, the apparatus of the inventionl includes a web speed measuring device, and an electronic control unit connected via a first connecting line to the web speed measuring device, the electronic control unit serving, via a second connecting line, for controlling the setting of the proportional valve and the pressure in the pneumatic cylinder in accordance with the instantaneous speed of the web.

The invention offers the advantage, in particular, that the apparatus can be retrofitted simply and economically in a conventional web-fed rotary offset printing press, by employing components which are used in the press, in part, for other regulating and control tasks; such retrofitting can generally be performed by implementing suitable control and regulation software in the control unit of the web-fed rotary offset printing press.

Other features which are considered as characteristic for the invention are set forth in the appended claims.

Although the invention is illustrated and described herein as embodied in a method and apparatus for regulating web tension in a web-fed rotary offset printing press, it is nevertheless not intended to be limited to the details shown, since various modifications and changes may be made therein without departing from the spirit of the invention and within the scope and range of equivalents of the claims.

The construction and method of operation of the invention, however, together with additional objects and advantages thereof will be best understood from the following description of specific embodiments and modes thereof when read in connection with the accompanying drawings, in which:

DESCRIPTION OF THE PREFERRED EMBODIMENTS

Figure 1:
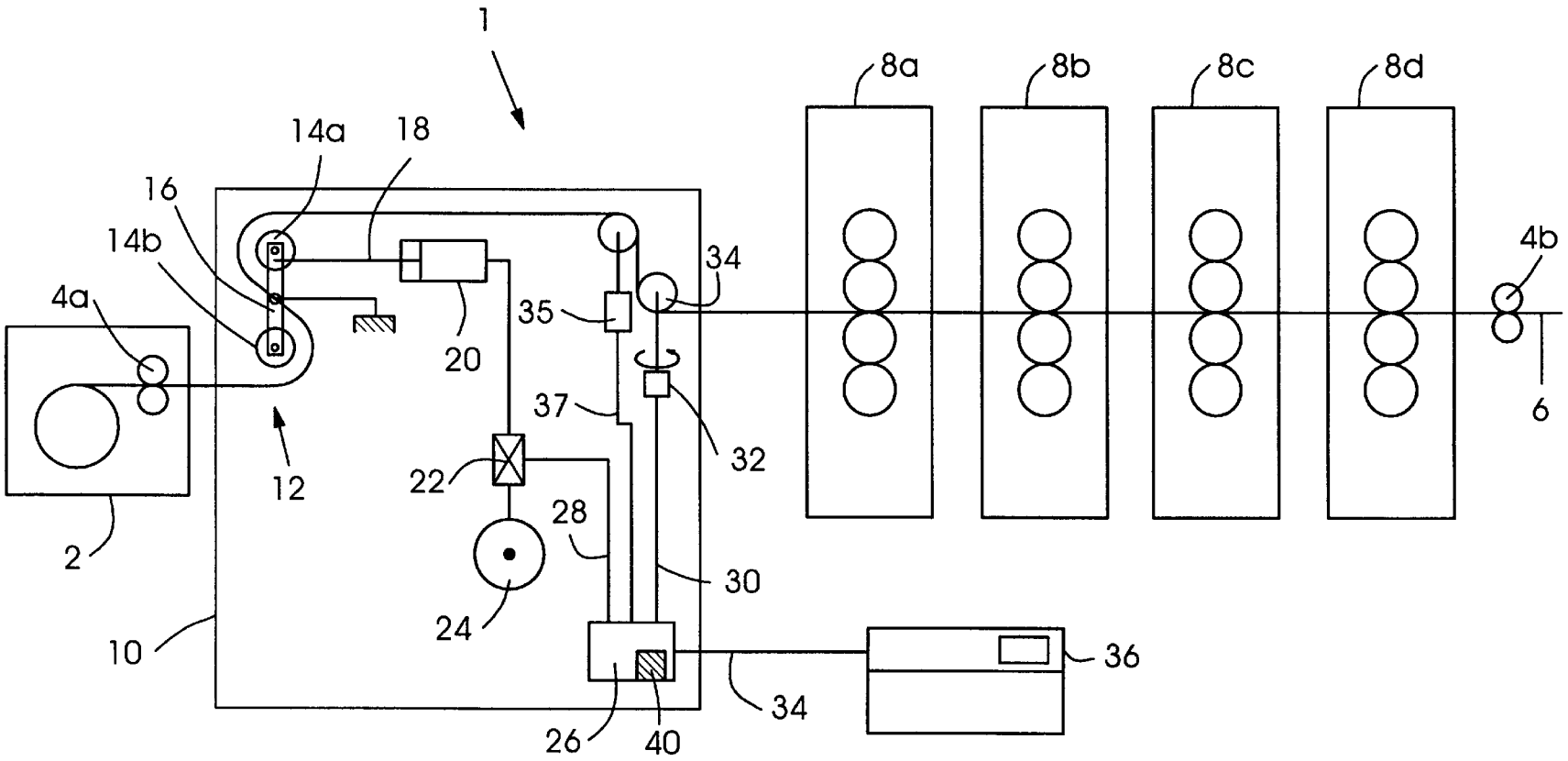
FIG. 1 is a diagrammatic side elevational view of a web-fed rotary offset printing press provided with an apparatus for performing the method for regulating web tension in accordance with the invention.

Referring now to the drawing and, first, particularly to FIG. 1 thereof, there is shown therein a web-fed rotary offset printing press 1 for printing on a paper web 6 withdrawn from a web stand 2 by tension roller pairs 4*a*, 4*b*, in one or more printing units 8*a* to 8*d*, which includes an apparatus 10 for regulating the tension in the paper web 6 during operation of the printing press 1.

The regulating device 10 includes a performance or dancer roller 12 which, by way of example, can have a roller pair 14*a*, 14*b* supported rotatably in a pivotable frame 16, the paper web 6 being wrapped around the roller pair 14*a*, 14*b* in the form of an S, as shown in FIG. 1.

The frame 16 is connected via a rod linkage 18 to a pneumatic cylinder 20, which is hydraulically connected to a compressed air source 24 via a regulating valve 22 and supply lines, which are unidentified by any reference numeral. The regulating valve 22, which is preferably a conventional proportional regulating valve, regulates the pressure in the pneumatic cylinder 20 in accordance with or as a function of the signals of an electronic control unit 26, with which it is connected via a line 28. The pneumatic pressure in the pneumatic cylinder 20, which can be adjusted via the regulating valve 22, acts upon the frame 16 via the rod linkage 18, causing the roller pair 14*a*, 14*b* of the dancer roller 12 to be pressed against the web 6 with a substantially constant force corresponding to the prevailing pressure in the pneumatic cylinder 20, thereby tensioning the web in a defined manner.

The electronic control unit 26 is also connected via a connecting line 30 to a device 32 for measuring the speed of the moving paper web 6, or a variable corresponding to the speed. The speed measuring device 32 may be, for example, a conventional speedometer or tachometer drive mechanism or an incremental transducer with suitable electronics for determining the speed, the speed measuring device 22 being driven, for example, via a web guide roller 34 and generating a signal corresponding to the web speed.

In the preferred embodiment of the invention, as shown in FIG. 1, a device 35 for measuring the tension of the web 6 is also provided and, by way of example, may be constructed as a conventional guide roller connected to an electronic dynamometer, the web 6 being guided over this guide roller. The web tension measuring device 35 is connected to the control unit 26 via a connecting line 37 and supplies the control unit with a signal corresponding to the web tension, which is hereinafter referred to as the signal T.

The control unit 26, in the preferred embodiment of the invention, is formed by a microprocessor circuit which, via a connecting line 34 is connected to a control panel 36, by which operating parameters and commands for controlling the printing press can be input in a conventional manner. The signals fed to the control unit 26 by the control panel are further processed by the microprocessor circuit into suitable signals for controlling the regulating valve 22.

The method by which the web tension is regulated by the apparatus 10 is described hereinafter in conjunction with FIGS. 2 and 3.

Figure 2:
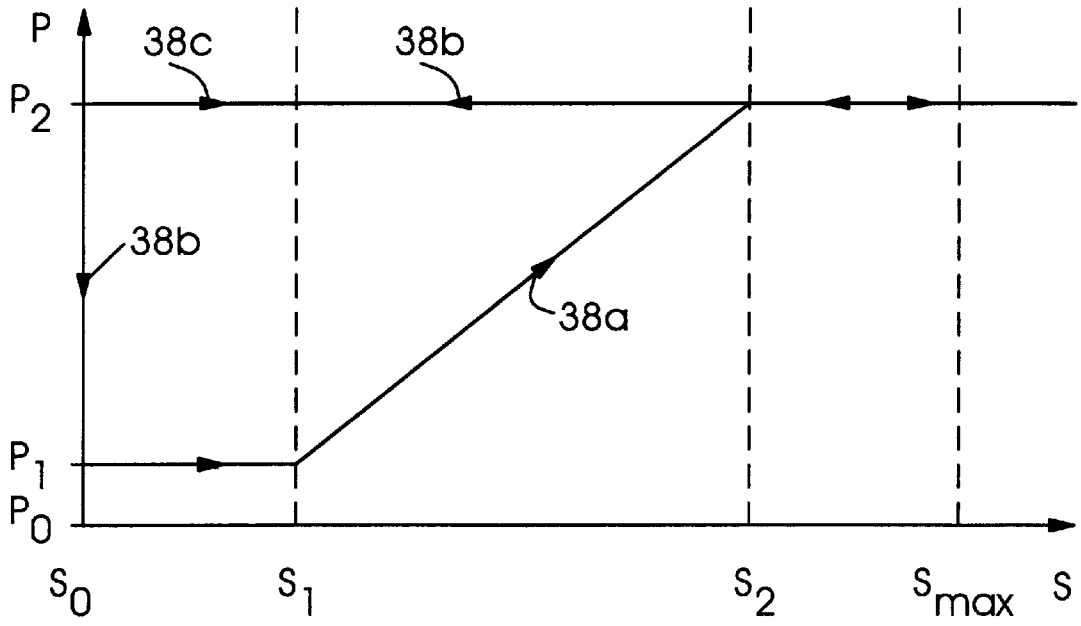
FIG. 2 is a plot diagram showing the course of web tension as a function of the speed of the web of material to be printed on in one embodiment of the invention.

As shown in FIG. 2, the apparatus 10 regulates the pressure in the pneumatic cylinder 20 in such a way that when the printing press is stopped, that is, at a speed $S=S_0$, this pressure has a value $P_0$, which is preferably 0 bar, so that the dancer roller 12 exerts no pressure whatsoever on the paper web 6. Consequently, it is possible to pivot the dancer or compensating roller 12 into an arbitrary or desired position, if necessary.

The first time the printing press 1 is run up to operating speed, for example, after a new paper web 6 has been inserted for a new printing job or after a web has been torn or broken, the pressure P in the pneumatic cylinder 20 is increased via the valve 22 to a value $P_1$, which as shown in FIG. 2 has a substantially constant value up to a first speed value $S_1$ of the paper web 6. The value for $S_1$ may be, for example, in a range between 20 copies per hour and 150 copies per hour. Due to the pressure $P_1$ prevailing in the pneumatic cylinder 20, a pressure which is comparatively low and may have a value of 0.1 to 0.5 bar, for example, the dancer roller 12 is acted upon by a slight but constant pressure. As a result, particularly upon the insertion of the paper web 6 into the printing press 1, the insertion process is facilitated. A possible danger of tearing or breaking the paper web 6 due to a sudden increase in the pressure in the pneumatic cylinder 20 after the insertion process at which the dancer roller 12 would be pressed suddenly at high pressure against the paper web 6, as often occurs in the prior art, is avoided.

The instant that the speed S of the paper web 6 exceeds a predetermined, preferably adjustable speed value $S_1$, as the further run-up of the printing press to operating speed continues, the pressure P in the pneumatic cylinder 20 is increased via the regulating valve 22, together with the web speed S, until the web speed attains a value $S_2$, which by way of example may be 20% below the maximum speed of the printing press.

The pressure P in the pneumatic cylinder 20 associated with the web speed $S_2$ is designated as $P_2$ in FIG. 2 and may, for example, amount to ten times the value of the pressure $P_1$, for example, being 5 to 8 bar. Although specific figures for the speed S of the paper web 6 and the pressure P have been given hereinabove, it is understood that the speed and pressure are not limited to these values but instead should be selected depending upon the construction or design of the dancer or compensating roller 12 and the pneumatic cylinder 20, upon the type of paper being used, upon the width of the paper web, and upon other press parameters.

The increase in the pressure P in the pneumatic cylinder 20 within the speed range between $S_1$ and $S_2$ is preferably effected linearly with the speed S of the paper web 6, the proportionality factor being defined by the relationship $(P_2-P_1)/(S_2-S_1)$. Upon a further increase in the speed S, for example, to maximum speed $S_{max}$, the pressure P is kept substantially constant and is not increased further. In FIGS. 2 and 3, the course of the pressure P upon run-up of the printing press to operating speed is indicated as a function of the speed S by the arrowheads 38*a* directed to the right-hand side of the figures.

Figure 3:
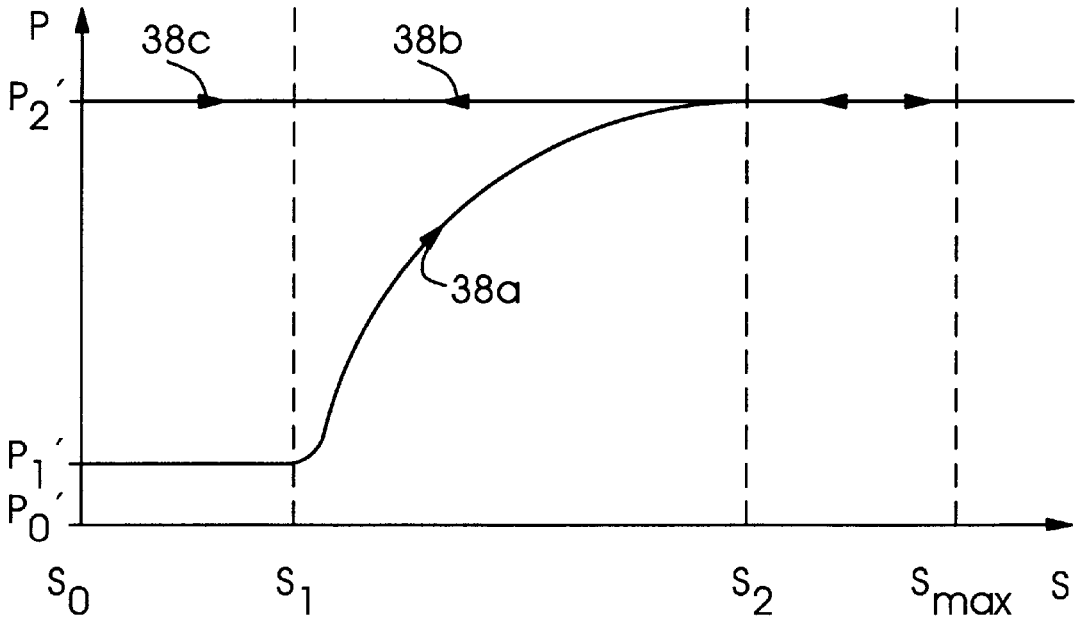
FIG. 3 is a plot diagram showing the course of the web tension as a function of the web speed in another embodiment of the invention.
Figure 4:
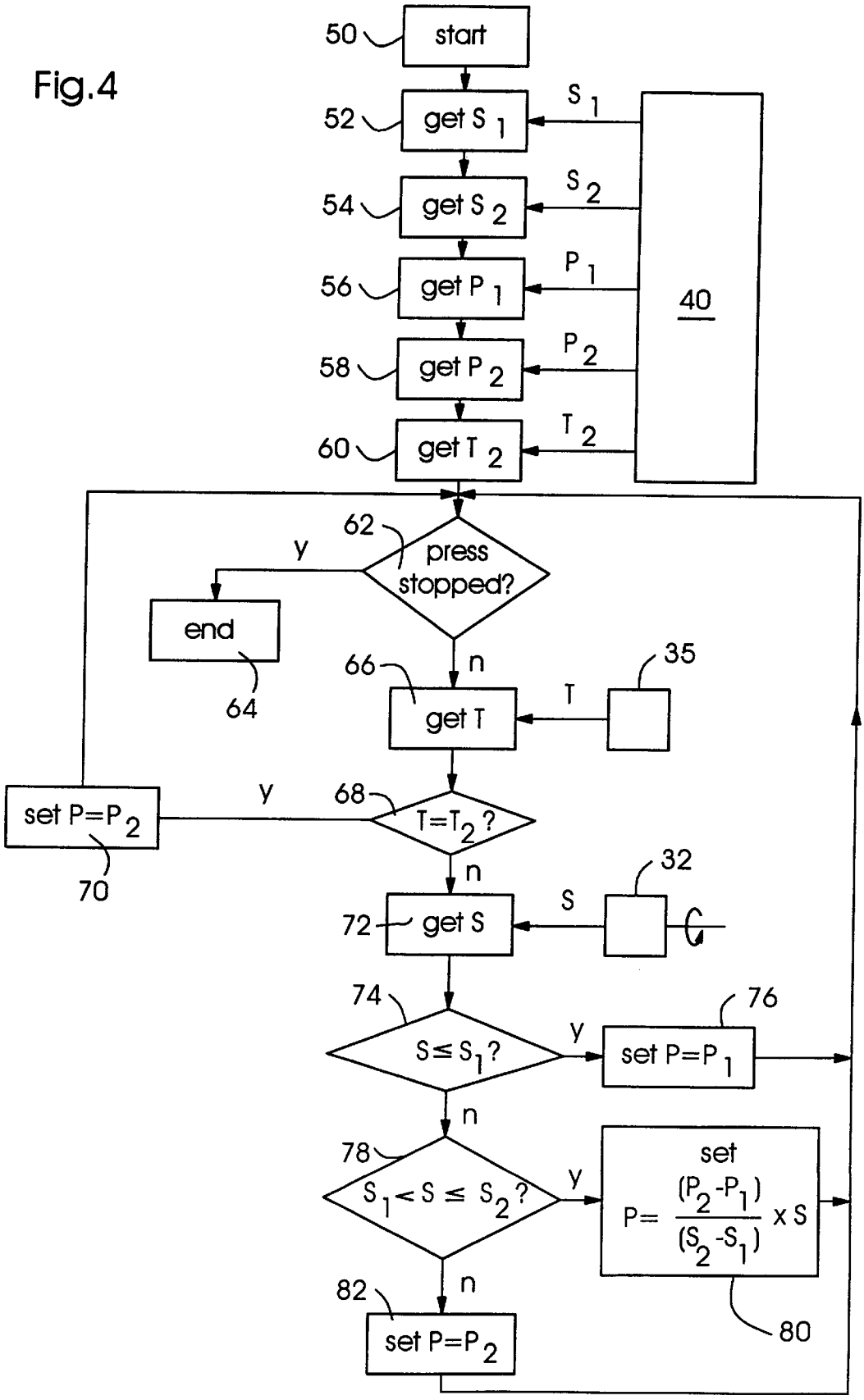
FIG. 4 is a flowchart illustrating the sequence of regulation steps taking place when the method according to the invention is performed in a web-fed rotary offset printing press.

When the printing press slows down, which is indicated in FIGS. 2 and 3 by the arrowheads 38*b* directed towards the left-hand side, the pressure P on passing through the range between $S_2$ and $S_1$ is preferably not reduced linearly with the speed as in the run-up, even though such a reduction may be performed in the same manner; instead, the pressure P is kept substantially constant at the value $P_2$ until the speed value $S_0$ is reached. Only upon attainment of the speed value $S_0$, that is, as a rule when the printing press is stopped or at a very slight web speed, is a change produced in the pressure P in the pneumatic cylinder 20, depending upon whether or not the web tension value T, measured by the web tension measuring device 35 and fed to the control unit 26, agrees with a predetermined web tension value $T_2$, which may, for example, be stored in the memory device 40 (see FIG. 4) and which preferably corresponds to the web tension at the pressure $P_2$ in the pneumatic cylinder 20.

In the case of a tear or break in the web, in which the printing press is turned off by an emergency stop and the web tension measuring device 35 measures a web tension T=0, the pressure P in the pneumatic cylinder 20 is reduced to the value $P_0$, that is, as a rule to 0, so that after a new web 6 is inserted, the course designated by the arrowheads 38*a* in FIG. 1 is taken once again.

If the printing job were merely interrupted, however, in order to eliminate a problem in the folding apparatus, for example, then even in the ensuing run-up of the printing press back to operating speed, the pressure P in the pneumatic cylinder 20 is kept substantially constant at the value $P_2$. In that case, the web tension measuring device 35 measures a web tension value T which agrees substantially with the web tension value $T_2$ corresponding to the pressure $P_2$. The course of the web tension as the printing press is run back up to operating speed during an ongoing printing job, without any shutdown of the printing press because of a tear or break in the web, is indicated in FIGS. 2 and 3 by the arrowheads 38*c*.

In the preferred mode of the method according to the invention, the values for the speed $S_1$ and pressure $P_1$, and the speed S2 and pressure $P_2$ are preferably freely variable by the pressman and can be input by the pressman, for example, via the control panel 36, into a memory 40, which is illustrated in FIG. 1 as a component of the electronic control unit 26.

In a further mode of the method according to the invention, the pressure P in the pneumatic cylinder 20, and consequently the web tension, within the range of speeds $S_1$ and $S_2$, as shown in FIG. 2, is increased in a nonlinear manner from a value $P_1$, to a second value $P_{2'}$. The increase or rise can then be exponential with the speed S, for example. In this mode of the method according to the invention, as well, while the printing press slows down (arrow 38*b*), the pressure P is preferably kept substantially constant at the value $P_{2'}$, and only when the speed $S=S_0$ is reached, as described hereinabove in conjunction with FIG. 1, in accordance with or as a function of the web tension value T resulting when a tear or break has occurred in the web, is it reduced to the value $P_{1'}$ or $P_{0'}$ and, at a web tension value $T_2$ corresponding to the pressure $P_2$, it is kept at the pressure value $P_2$.

In the preferred construction of the equipment which is used, the method of the invention is realized by suitable control software in the electronic control unit 26. An example of a program sequence for such control software, which is of the type used for regulating the web tension in FIG. 2, is shown in the flow chart of FIG. 4.

After the program start in step 50, which preferably takes place when the printing press is turned on, the values stored in the memory 40 for the speed $S_1$, $S_2$ and the associated pressure $P_1$ and $P_2$ and the web tension $T_2$ are read in steps 52, 54, 56, 58, 60. As previously described hereinabove, the values for $S_1$, $S_2$, $P_1$ and $P_2$ are preferably freely variable by the pressman via the control panel 26. Provision may also be made, however, for the values to be stored permanently and nonvariably in the memory 40.

In the next program step 62, the electronic control unit 26 ascertains whether the printing press has been turned off. If the printing press has been turned off by the pressman, the program is ended at step 64. If it has not been turned off, however, which is indicated by the letter n below the step 62, then in the next program step 66, the instantaneous value for the web tension T is ascertained by the web tension measuring device 35. In the next method step 68, the control unit 26 determines whether the web tension value T agrees with the web tension value $T_2$. If this is the case, then in step 70, the pressure P is set to the value $P_2$, and a jump back to step 62 takes place. If the value of the web tension T does not agree with the value $T_2$, for example, in the event that the printing press in a new printing job is being run up to operating speed for the first time or if a web tear or break has occurred during the ongoing printing job, then the control unit 26, in the next method step 72, ascertains the instantaneous value for the speed S of the web 6 from the speed measuring device 32. In an ensuing method step 74, the electronic control unit 26 determines whether the instantaneous speed S is less than or equal to the speed value $S_1$ read out in step 52. If so, then in step 76, the pressure P in the pneumatic cylinder 20 is set via the regulating valve 22 to the pressure value $P_1$, and the program sequence begins again at step 62.

If the value for the instantaneous speed S is not less than or equal to the value $S_1$, then in the next method step 78, the electronic control unit 26 determines whether the instantaneous speed S is greater than the value $S_1$ and less than or equal to the value $S_2$. If such is the case, then in step 90, the pressure P in the pneumatic cylinder 20 is set to a value $(P_2-P_1)/(S_2-S_2)\times S$, and the program then jumps back to step 62.

If the instantaneous speed is not greater than $S_1$ and less than $S_2$, then in the further step 82, the pressure P is set to the value $P_2$, and the program jumps back to step 62.

We claim:

1. A method for regulating web tension in a web-fed rotary offset printing press, which comprises:

running up the printing press to a given speed; and simultaneously increasing web tension over a predetermined speed range, substantially linearly with web speed.

2. The method according to claim 1, wherein the speed range is adjustable, and which includes adjusting the speed range.

3. The method according to claim 2, which includes adjusting the beginning of the speed range at a first web speed value greater than 0.

4. The method according to claim 3, wherein the first web speed value is in a range between 1000 and 2000 copies per hour.

5. The method according to claim 3, wherein the speed range ends at a second web speed value below maximum web speed, and which includes keeping the web tension substantially constant above the second web speed value.

6. The method according to claim 1, which includes varying the increase in web tension in accordance with the web speed.

7. The method according to claim 3, which includes adjusting the web tension value associated with the first web speed value.

8. The method according to claim 5, which includes adjusting the web tension value associated with the second web speed value.

9. A method for regulating the web tension in a web-fed rotary offset printing press, which comprises:

running up the printing press to a given speed; and simultaneously increasing web tension over a predetermined speed range, nonlinearly with web speed.

10. The method according to claim 9, which includes increasing the web tension substantially exponentially with the web speed.

11. The method according to claim 1, which includes keeping the web tension substantially constant as the printing press runs down.

12. The method according to claim 9, which includes keeping the web tension substantially constant as the printing press runs down.

13. An apparatus for regulating web tension in a web-fed rotary printing press, comprising:

a compressed-air source;

a proportional valve;

a regulating device for regulating web tension including a compensating roller and a pneumatic cylinder connected to said compressed-air source via said proportional valve for positioning said compensating roller against a moving web of material;

a web speed measuring device;

first and second connecting lines; and an electronic control unit connected via said first connecting line to said web speed measuring device, said electronic control unit controlling via said second connecting line a setting of said proportional valve and a pressure in said pneumatic cylinder depending on the instantaneous speed of the web.

* * * * *